US006958670B2

(12) United States Patent
Winslow et al.

(10) Patent No.: US 6,958,670 B2
(45) Date of Patent: Oct. 25, 2005

(54) OFFSET CONNECTOR WITH COMPRESSIBLE CONDUCTOR

(75) Inventors: David T. Winslow, Culver City, CA (US); Colleen Tallman, Playa Del Rey, CA (US); Timothy Keesey, Garden Grove, CA (US); James P. Treinen, Playa Del Rey, CA (US); John A. Crockett, Anaheim, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/633,256

(22) Filed: Aug. 1, 2003

(65) Prior Publication Data

US 2005/0024168 A1 Feb. 3, 2005

(51) Int. Cl.[7] ..... H01P 5/00
(52) U.S. Cl. ..... 333/260; 333/243
(58) Field of Search ..... 333/260, 246, 333/243, 33, 244; 439/66

(56) References Cited

U.S. PATENT DOCUMENTS 5,552,752 A 9/1996 Sturdivant et al. ..... 333/243
5,633,615 A 5/1997 Quan ..... 333/33
5,675,302 A 10/1997 Howard et al. ..... 333/243
5,703,599 A * 12/1997 Quan et al. ..... 342/368
5,872,550 A 2/1999 Quan et al. ..... 343/905
6,094,115 A 7/2000 Nguyen et al. ..... 333/260
6,102,709 A 8/2000 Howard et al. ..... 439/66
6,166,615 A 12/2000 Winslow et al. ..... 333/260
6,366,185 B1 4/2002 Keesey et al. ..... 333/260

* cited by examiner

*Primary Examiner*—Stephen E. Jones
(74) *Attorney, Agent, or Firm*—Leonard A. Alkov; Karl A. Vick

(57) ABSTRACT

A connector providing an offset interconnect has a dielectric body with first and second longitudinally opposed and laterally offset portions and an internal cavity. An offset electrically conductive path is disposed within the internal cavity. The offset electrically conductive path extends from the first portion of the dielectric body to the second portion of the dielectric body. A compressible conductor is disposed within the internal cavity in the second portion of the dielectric body.

36 Claims, 4 Drawing Sheets

OFFSET CONNECTOR WITH COMPRESSIBLE CONDUCTOR

BACKGROUND OF THE DISCLOSURE

The continued reduction in size of RF and other electrical components creates a need for compact RF connections that meet both electrical and mechanical requirements. Some microwave applications require an RF interconnection between adjacent components. The adjacent components may be substrates or circuit boards comprising layers in a stacked assembly. Connectors suitable for RF connections may also be suitable for digital (DC) signals.

RF interconnects may be used to connect a mating portion of one component to a corresponding mating portion of another component. The corresponding mating portions may comprise elements of a grid pattern on one or both components. If the mating portions of the two components are on-grid with one another when in the assembled condition, the mating portions can be connected by a straight connector.

RF interconnects used to provide straight connections between layers in a stacked assembly include various types of connectors with compressible conductors. The compressible conductors include spring probes and compressible wire bundles. A compressible bundle may be wire mesh.

If the mating portions of adjacent components are off-grid, or laterally offset, from one another in the assembled condition, an offset RF interconnect is needed. RF interconnects used to provide offset connections between adjacent components, substrates or circuit boards include bent pins molded into offset dielectric molds. Bent pins, by themselves, do not provide the z-axis float needed to accommodate tolerance build up. Using a socket can require pins on the mating component, which could create yield problems due, at least in part, to pin misalignment and irregularities.

SUMMARY OF THE DISCLOSURE

A connector providing an offset interconnect has a dielectric body with first and second longitudinally opposed and laterally offset portions and an internal cavity. An offset electrically conductive path is disposed within the internal cavity. The offset electrically conductive path extends from the first portion of the dielectric body to the second portion of the dielectric body. A compressible conductor is disposed within the internal cavity in the second portion of the dielectric body.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF EXEMPLARY EMBODIMENTS

The connector of the disclosure may be used to connect a first mating portion of a first component with a second mating portion of a second component. The first mating portion and the second mating portion may be offset or off-grid from one another.

The connector provides a robust and simple electrical connection which may also be impedance controlled and could be used wherever RF or digital interconnects are used. The desired characteristic impedance of the entire electrical path in a particular application may be chosen by appropriate selection of factors which may include the diameters of the compressible conductor, the electrical conductive path, the outside diameter of the dielectric body and the diameter of the internal cavity within the dielectric body and the dielectric constant of the dielectric. For example, an exemplary characteristic impedance could be 50 ohms. In an exemplary embodiment, the connectors are suitable for use in RF connections with frequencies in a range from 0 to at least 18 GHz and may also be used for digital connections.

Integrating compressible conductors into a molded dielectric with a "bent" outside configuration allows for fanning, or spreading out, of interconnects. The bend or offset provides a method of connecting components which are not "on grid" with each other.

Compressible conductors suited for this purpose include compressible wire bundles and spring probes. The compressible wire bundle may be compressible wire mesh. Persons of skill in the art will appreciate that other types of compressible conductors may also be used with the connector of this disclosure. The use of compressible conductors accommodates z-axis tolerances and allows for densely populated packaging technology.

The electrical connection with a mating component may be made by a spring probe, plunger or wire mesh contacting an electrical contact pad of the mating component. The electrical connection can also be made by having a fixed pin inserted into wire mesh. Pins on the mating component can be a source of high failure rates due, in part, to pin misalignment and irregularities. Using a spring probe permits the elimination of pins on the mating component, thereby eliminating one source of failure in some applications. Where a compressible wire bundle connector is used, the electrical connection with a mating component can be made either with a contact pad or a pin, adding to packaging flexibility and reliability. For any given application, the particular connector to be used may be determined in view of manufacturing, assembly, impedance or other considerations.

Figure 1:
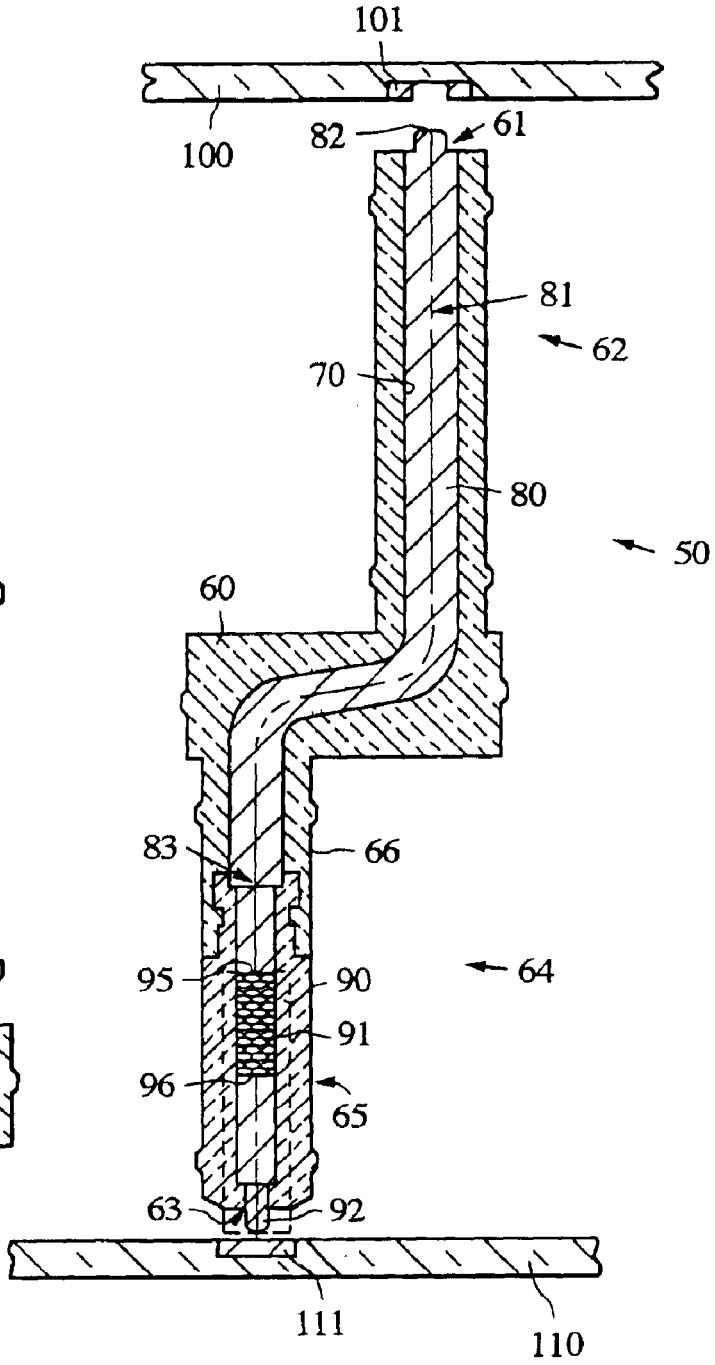
FIG. 1 is a cross-sectional view of an embodiment of a connector assembly and first and second mating components with mating portions to which electrical contact is to be made.

An exemplary embodiment of a connector apparatus for providing an offset interconnect is illustrated in FIG. 1.

An apparatus 50 is provided to make an RF connection between a first mating portion 101 of a first component 100 to a corresponding second mating portion 111 of a second component 110. The apparatus 50 includes a dielectric body 60 with a first portion 62 and a second portion 64. The dielectric body 60 has an internal cavity 70. The internal cavity 70 extends from a first opening 61 in the first portion 62 of the body 60 to a second opening 63 in the second portion 64 of the body 60. The first and second portions 62, 64 are longitudinally opposed and laterally offset. The first and second openings 61, 63 are longitudinally opposed and laterally offset.

The body 60 can be a two piece structure including a first body member 65 and a second body member 66. The body members 65 and 66 are each fabricated of a dielectric material with a dielectric constant. The dielectric material may be molded and can be Teflon-based. The dielectric material of the body 60 can be, for instance, Teflon or TAX (™—available from Mitzi Plastics). In the alternative, the body may be formed or molded as a single piece. Persons skilled in the art will appreciate that other arrangements of the body may also be used in various embodiments of the connector of the disclosure.

The internal cavity 70 is shaped to accommodate conductors forming a laterally offset electrically conductive path 81. The offset electrically conductive path may include at least a first conductor 80 disposed within the dielectric body 60. The first conductor may be molded, placed into or assembled directly into the dielectric body 60. The first conductor may be, for example, a conductive pin that is bent, which for example may be a metal pin.

The shape of the internal cavity 70 is designed to accommodate the laterally offset electrically conductive path 81 to meet the offset requirements of a particular application. The offset requirements of a particular application may take into account, for example, the lateral offset of the first and second mating portions 101, 111.

The first conductor extends toward and may extend to or protrude out from the first opening 61 in the first portion 62 of the body 60. Although the first conductor 80 shown in FIG. 1 is a single bent metal pin protruding out from the first opening 61, it is understood that an offset electrical path may be provided by any number of electrically connected conductors providing a single electrically conductive path with an appropriately offset path.

The first conductor 80 has a first end 82 in the first portion of the body 60. The first end 82 of the first conductor 80 provides the electrical connection to the first mating portion 101 and may be in direct contact with the first mating portion 101 of the first component 100. A second end of the first conductor 83 is disposed within the internal cavity and oriented toward the second mating component 110.

A compressible conductor 90 is also disposed in the internal cavity 70. The compressible conductor 90 may be disposed in the second portion 64 of the body 60. The compressible conductor 90 may form part of the offset electrically conductive path 81. The compressible conductor may be electrically connected to the first conductor 80 at a first end 95 of the compressible conductor. The first end 95 of the compressible conductor 90 is oriented in the direction toward the first portion of the body 60. A second end of the compressible conductor may extend toward or protrude out from the second opening 63 of the body 60.

The compressible conductor may provide an electrical connection to the second mating portion of the second component and may be in direct contact with the second mating portion of the second component.

In FIG. 1, the compressible conductor includes a wire bundle 91 and a plunger 92. The wire bundle 91 is positioned at a second end of the first conductor and the plunger 92 is positioned at the second end of the wire bundle 96. The compressible wire bundle may be a gold plated wire bundle.

The plunger 92 is a conductor which is electrically connected to the compressible wire bundle at one end and extends toward and may protrude from the second opening 63 at its other end. The plunger 92 may be, for example, an electrical connection pin. The electrical connection pin, by way of example, may be metal.

The diameter of the plunger, wire bundle and the outside diameter and dielectric constant of the dielectric may be selected to ensure that the entire electrical path is of the characteristic impedance required in the application. This characteristic impedance may be, for instance, 50 ohms.

In another embodiment, the compressible conductor could include a wire bundle 91 without a plunger 92. In such an embodiment, the compressible wire bundle may be electrically connected to the first conductor at the first end of the compressible conductor 90 and extend to and may protrude from the second opening 63 in the second portion of the body 60. In such an embodiment, the end of the wire bundle oriented toward the second portion of the body 60 may make an electrical connection directly to the second mating portion. Where the compressible conductor includes a wire bundle without a plunger, the mating portion of the second component can be a pin or a flat conductor, thereby increasing the flexibility and reliability of the connector.

Figure 2:
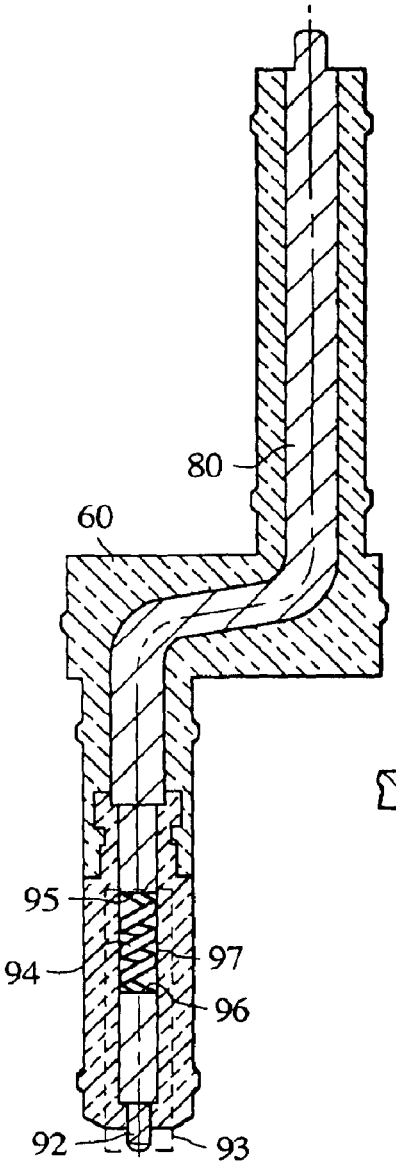
FIG. 2 is a cross-sectional view of another embodiment of a connector assembly.

In a further embodiment of the invention illustrated in FIG. 2, the compressible conductor is a spring probe 93. A spring probe may include a plunger 92 enclosed within a metal tube 97. The plunger may be oriented towards the second end of the spring 96 with the metal tube 97 oriented toward the first end of the compressible conductor 95. The spring probe may form part of the offset electrically conductive path 81. The spring probe may be electrically connected to a first conductor 80. The connection may be made, for example, by crimping or snapping or by being butted against one another, that is, adjacently captivated within the dielectric. The diameter of the offset electrically conductive path or the first conductor and of the outside diameter of the body along with the dielectric constant of the dielectric can be chosen to ensure the entire electrical path is of the characteristic impedance desired in a particular application. The desired impedance may be, for example, 50 ohms.

The plunger 92 may have a spring behind its base. The plunger can therefore move into the metal tube 97 freely against the force of the spring 94. The spring helps ensure that the plunger maintains contact and pressure on a mating component.

Figure 3:
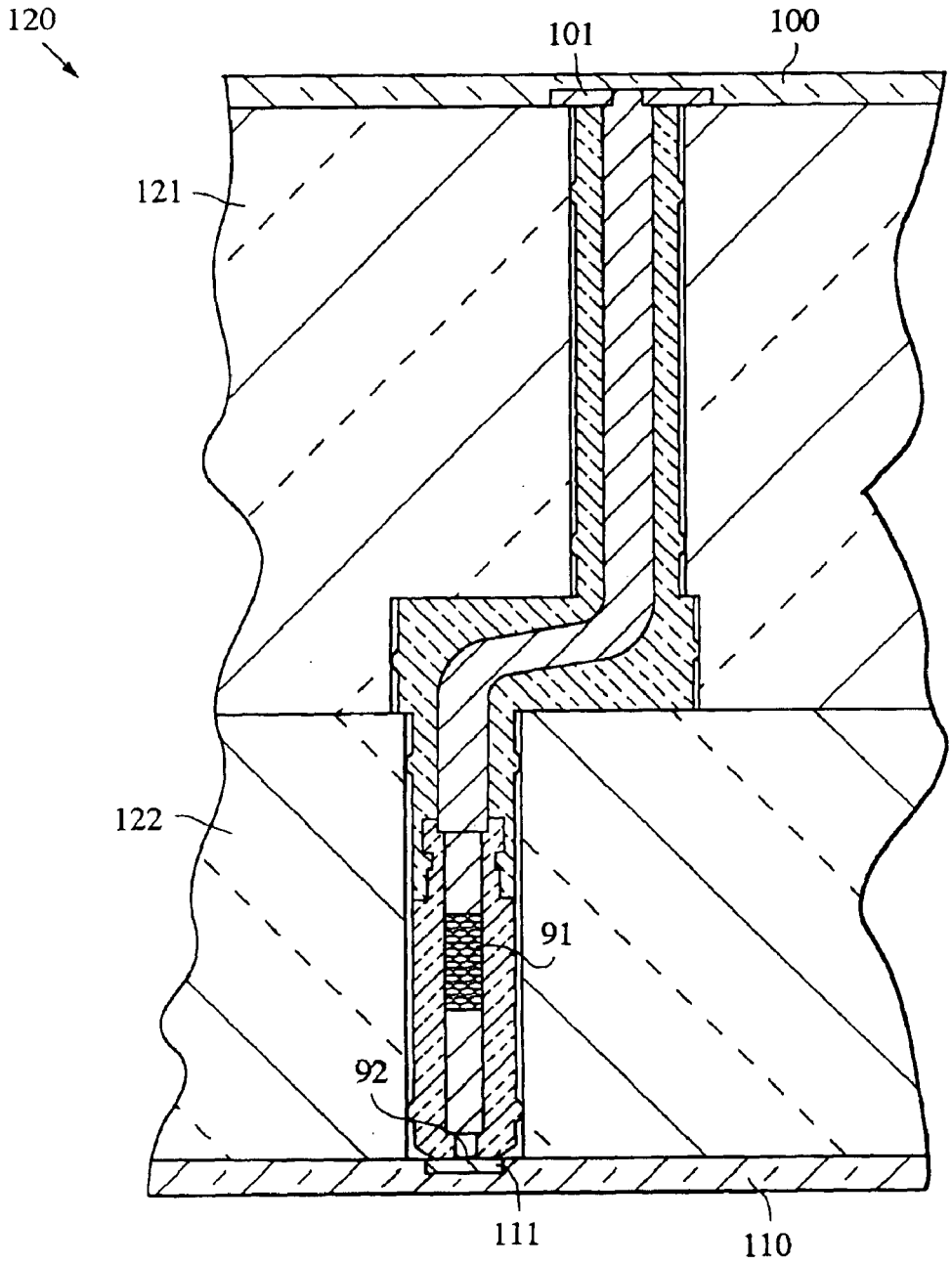
FIG. 3 is a cross-sectional view of the embodiment of FIG. 1 in a connector assembly in the assembled condition with connector housings in electrical contact with mating portions of first and second mating components.

FIG. 3 shows an apparatus in an assembled condition with a plunger 92 in contact with a mating portion 111 of a second component 110. An apparatus is provided to make an RF connection between a first mating portion 101 of a first component 100 to a corresponding second mating portion 111 of a second component 110. The first and second components 100, 110 may be adjacent substrates or circuit boards included as first and second layers in a stacked assembly 120. The stacked assembly may also include at least a first connector housing 121 and may include a second connector housing 122. The first and second mating portions 101, 111 may be pins, sockets or flat conductors. In the assembled condition, the first and second mating portions 101 and 111 may be laterally offset from one another. The first and second connector housings may be metal. The mating portions 101 and 111 may be sized so that they do not make contact with the first or second connector housing when in the assembled condition. An insulating layer, which may be a thin polymer layer, may be placed between the connector housings and the first and/or second components to prevent direct contact between the mating portions and the connector housings. The insulating layer or layers may have holes through which an electrically conductive path may extend to contact the first and/or second mating portions.

The embodiment illustrated in FIG. 3 has a compressible conductor with a plunger 92 and a compressible wire bundle

91. It is understood that the apparatus could be any other arrangement with a compressible conductor in accordance with the invention.

Figure 4:
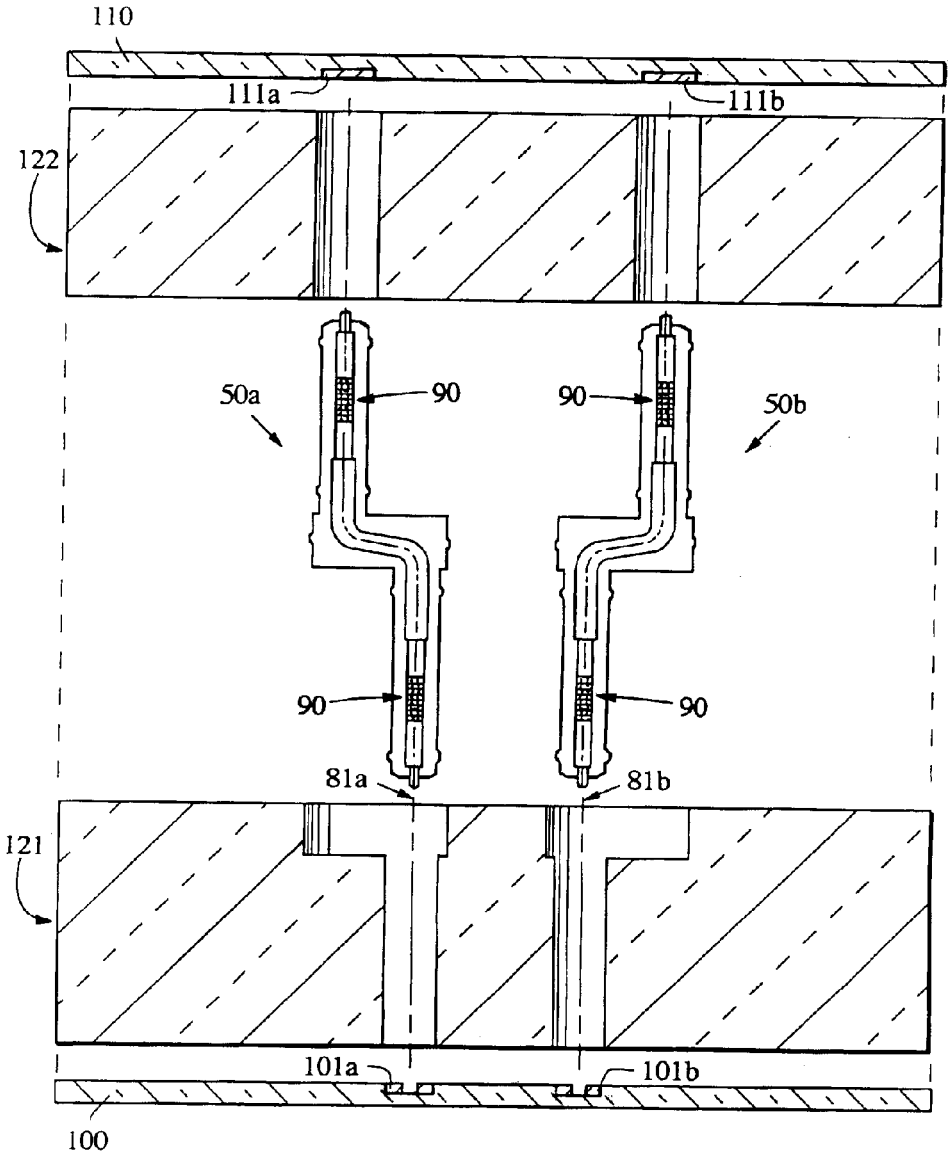
FIG. 4 is an exploded, cross-sectional view of an installation including a plurality of connectors.

FIG. 4 is an exploded, cross-sectional view of an installation including a plurality of connectors in accordance with the invention. Two connectors 50*a*, 50*b* make connections between closely grouped mating portions 101*a*, 101*b* on a first component 100 and less closely grouped mating portions 111*a*, 111*b* on a second component 110. The offset electrically conductive paths 81*a*, 81*b* fan away from or spread out from the mating portions on the first components. The offset electrically conductive paths may provide connections for components which are not on-grid with another component. The connectors 50*a* and 50*b* each have first and second compressible conductors 90 providing the electrical connections to the first and second mating components at each end of the connectors.

Figure 5:
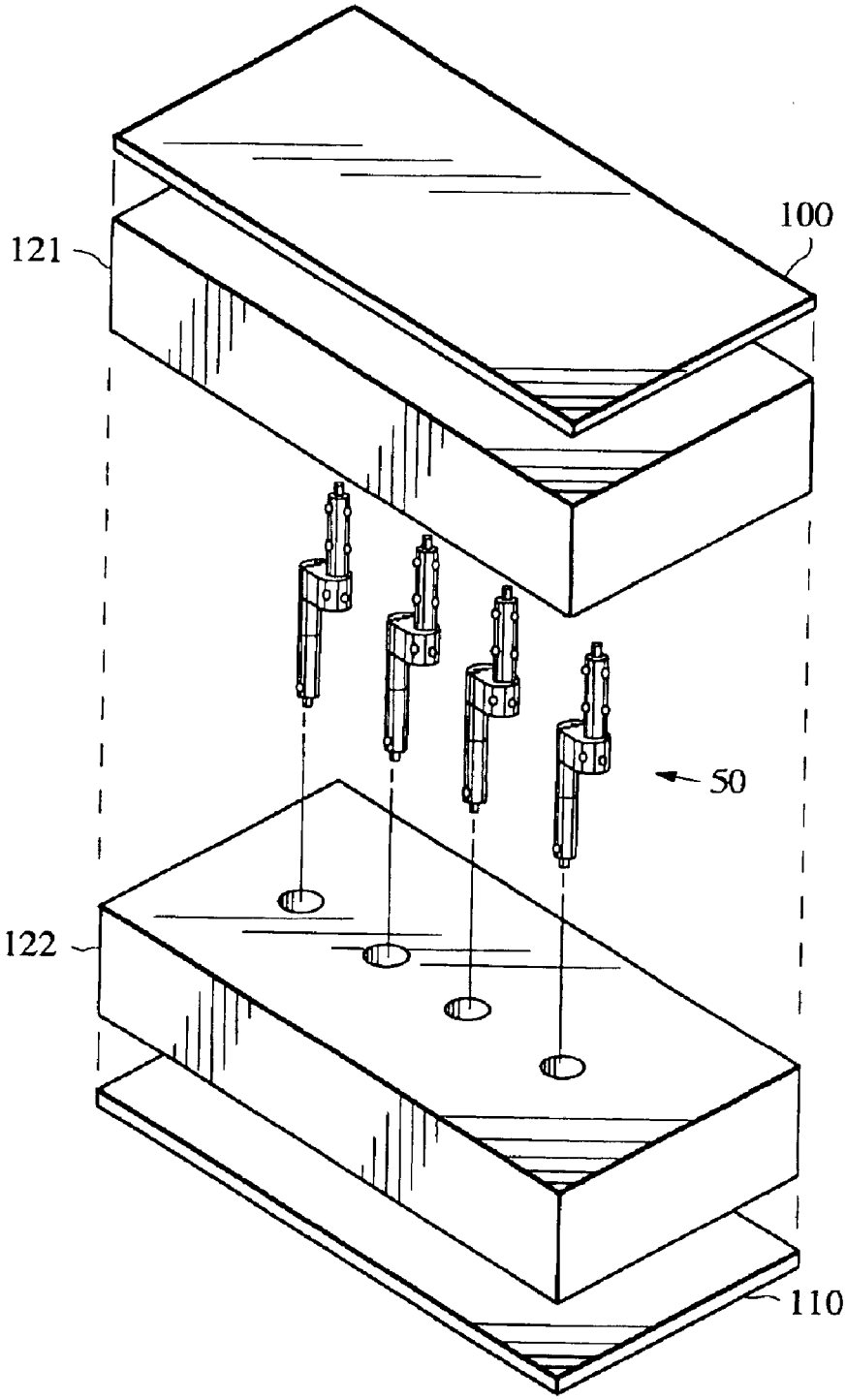
FIG. 5 is an exploded view of an assembly of connectors with connector housings and mating components.

FIG. 5 is an exploded view of an installation including a plurality of connectors 50, first and second connector housings 121, 122 and first and second mating components 100, 110. The connectors provide connections between mating portions of the first mating component 100 and corresponding, off-grid mating portions of the second mating component 110.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A connector providing an offset interconnect, comprising:

a dielectric body with first and second longitudinally opposed and laterally offset portions and an internal cavity, said dielectric body including a plurality of projections extending laterally outward from external surfaces of each of said first and second portions, wherein the plurality of projections are arranged to engage an internal surface of a connector housing; and an offset electrically conductive path disposed within the internal cavity, the offset electrically conductive path extending from the first portion of the dielectric body to the second portion of the dielectric body and including a compressible conductor disposed within the internal cavity in the second portion of the dielectric body.

2. The connector of claim 1, wherein:

the compressible conductor comprises a spring probe.

3. The connector of claim 1, wherein the connector has a tuned characteristic impedance.

4. The connector of claim 1, wherein:

the compressible conductor comprises a compressible wire bundle.

5. The connector of claim 4, wherein:

the compressible conductor further comprises an electrically conductive plunger in electrical connection with the wire bundle.

6. The connector of claim 1, wherein:

the electrically conductive path includes a first conductor with a first end disposed in the internal cavity in the first portion of the body and a second end disposed in the internal cavity in the second portion of the body, the second end of the first conductor being in electrical contact with the compressible conductor.

7. The connector of claim 6, wherein the connector has a tuned characteristic impedance.

8. The connector of claim 6, wherein the first conductor is a bent conductive pin.

9. The connector of claim 6, wherein:

the compressible conductor comprises a spring probe.

10. The connector of claim 6, wherein:

the compressible conductor comprises a compressible wire bundle.

11. The connector of claim 10, wherein:

the compressible conductor further comprises an electrically conductive plunger in electrical connection with the wire bundle.

12. An assembly comprising:

a connector with a dielectric body with first and second longitudinally opposed and laterally offset portions and an internal cavity, an offset electrically conductive path being disposed within the internal cavity and extending from the first portion of the dielectric body to the second portion of the dielectric body and including a compressible conductor disposed within the internal cavity in the second portion of the dielectric body, said dielectric body including a plurality of projections extending laterally outward from external surfaces of each of said first and second longitudinally opposed and laterally offset portions;

a component adjacent the second portion of the body having a substantially flat mating portion in contact with and arranged substantially perpendicular to an end of the compressible conductor; and a connector housing having an internal surface, wherein the plurality of of projections engage the internal surface of the connector housing.

13. The assembly of claim 12, wherein:

the compressible conductor comprises a spring probe.

14. The assembly of claim 12, wherein the connector has a tuned characteristic impedance.

15. The assembly of claim 12, wherein the connector housing includes a first connector housing portion and a second connector housing portion.

16. The assembly of claim 12, wherein the connector housing comprises metal.

17. The assembly of claim 12, wherein:

the compressible conductor comprises a compressible wire bundle.

18. The assembly of claim 17, wherein:

the compressible conductor further comprises an electrically conductive plunger in electrical connection with the wire bundle.

19. The assembly of claim 12, wherein:

the electrically conductive path includes a first conductor with a first end disposed in the internal cavity in the first portion of the body and a second end disposed in the internal cavity in the second portion of the body, the second end of the first conductor being in electrical contact with the compressible conductor.

20. The assembly of claim 19, wherein the first conductor is a bent conductive pin.

21. The assembly of claim 19, wherein:

the compressible conductor comprises a spring probe.

22. The assembly of claim 19, wherein:

the compressible conductor comprises a compressible wire bundle.

23. The assembly of claim 22, wherein:

the compressible conductor further comprises an electrically conductive plunger in electrical connection with the wire bundle.

24. A method for connecting a mating portion of a first component with a mating portion of a second component, comprising:

providing a connector with a dielectric body with first and second longitudinally opposed and laterally offset portions and an internal cavity, an offset electrically conductive path being disposed within the internal cavity and extending from the first portion of the dielectric body to the second portion of the dielectric body and including a compressible conductor disposed within the internal cavity in the second portion of the dielectric body, wherein a plurality of projections extend laterally from an external surface of the dielectric body;

disposing the connector within a connector housing, the connector housing comprising an internal surface;

engaging the plurality of projections with the internal surface of the connector housing;

positioning a first component with a first mating portion adjacent the first portion of the dielectric body such that a first end of the electrically conductive path is in electrical contact with the first mating portion; and positioning a second component with a second mating portion adjacent the second portion of the body such that an end of the compressible conductor is in electrical contact with the second mating portion, wherein the second mating portion is substantially flat and arranged substantially perpendicular with the compressible conductor.

25. The method of claim 24, wherein:

the compressible conductor comprises a spring probe.

26. The method of claim 24, wherein the connector has a tuned characteristic impedance.

27. The method of claim 24, wherein the connector housing includes a first connector housing portion and a second connector housing portion.

28. The method of claim 24, wherein the connector housing comprises metal.

29. The method of claim 24, wherein:

the compressible conductor comprises a compressible wire bundle.

30. The method of claim 29, wherein:

the compressible conductor further comprises an electrically conductive plunger in electrical connection with the wire bundle.

31. The method of claim 24, wherein:

the electrically conductive path includes a first conductor with a first end disposed in the internal cavity in the first portion of the body and a second end disposed in the internal cavity in the second portion of the body, the second end of the first conductor being in electrical contact with the compressible conductor.

32. The method of claim 31, wherein the conductor has a tuned characteristic impedance.

33. The method of claim 31, wherein the first conductor is a bent conductive pin.

34. The method of claim 31, wherein:

the compressible conductor comprises a spring probe.

35. The method of claim 31, wherein:

the compressible conductor comprises a compressible wire bundle.

36. The method of claim 35, wherein:

the compressible conductor further comprises an electrically conductive plunger in electrical connection with the wire bundle.

* * * * *

UNITED STATES PATENT AND TRADEMARK OFFICE

CERTIFICATE OF CORRECTION

PATENT NO. : 6,958,670 B2
DATED : October 25, 2005
INVENTOR(S) : David T. Winslow et al.

It is certified that error appears in the above-identified patent and that said Letters Patent is hereby corrected as shown below:

Column 3,
Line 6, delete "TAX" and insert -- TPX --.
Line 7, delete "Mitzi" and insert -- Mitsui --.

Signed and Sealed this

Eleventh Day of April, 2006

JON W. DUDAS
*Director of the United States Patent and Trademark Office*